US005499524A

United States Patent [19]

Len

[11] Patent Number: 5,499,524

[45] Date of Patent: Mar. 19, 1996

[54] WHEEL REPAIR STAND

[76] Inventor: Aaron Len, 25A Viljoen Street, Rouxville, Johannesburg, South Africa, 2192

[21] Appl. No.: 261,345

[22] Filed: Jun. 16, 1994

[30] Foreign Application Priority Data

Dec. 21, 1993 [GB] United Kingdom ..... 9326068

[51] Int. Cl.[6] ..... B21D 3/14; B21J 13/04

[52] U.S. Cl. ..... 72/420; 72/316; 72/447; 72/31.02; 269/71

[58] Field of Search ..... 72/293, 311, 316, 72/420, 455, 466, 479, 701, 447; 269/67, 69, 70, 71

[56] References Cited

U.S. PATENT DOCUMENTS

| | | | |
|---|---|---|---|
| 1,580,924 | 4/1926 | Shannon | 269/71 |
| 1,786,847 | 12/1930 | Hunt | 72/420 |
| 2,233,371 | 2/1941 | Smith . | |
| 2,244,927 | 6/1941 | Vanstone et al. | 72/316 |
| 2,282,118 | 5/1942 | Daniel | 72/420 |
| 2,489,815 | 11/1949 | Rader | 72/420 |
| 2,767,764 | 10/1956 | Smith | 72/34 |
| 3,855,831 | 12/1974 | Senkyrik | 72/32 |
| 5,303,573 | 4/1994 | Douglas | 72/420 |

FOREIGN PATENT DOCUMENTS

WO9308940 5/1993 WIPO .

*Primary Examiner*—David Jones
*Attorney, Agent, or Firm*—Ladas & Parry

[57] ABSTRACT

A wheel repair stand includes a frame with a pair of horizontal support beams to support a turntable. A wheel may be mounted on the turntable and radial forces applied by an extensible tool between the frame and the wheel rim. The wheel may be rotated on the turntable to allow the force to be applied at the desired location.

9 Claims, 6 Drawing Sheets

WHEEL REPAIR STAND

The present invention relates to a method and device for repairing wheel rims, and more particularly, to a method and device for repairing the metal rims of bicycles and motor vehicle wheels after the rims have been dented or bent out of shape.

As is well, known, the wheels of most, if not all, bicycles and motor vehicles, such as cars, trucks, motorbikes, etc., consist of two main parts: a circular metal or alloy rim and a rubber tire disposed circumferentially around the periphery of the rim. One of the main purposes of the rim is to provide structural strength to the wheel. Herein, the term "metal rim" will be used to refer to a rim made of metal or alloy.

After excessive and repeated use, the metal wheel rims of motor vehicles may become damaged in a number of ways. For example, a metal wheel rim may become dented or fractured, or the metal wheel rim may be distorted from a circular shape. As well, portions of the metal rim may become worn, etc. Thus, after excessive use, especially when the vehicle is used in rough terrain or under heavy loads, or when the vehicle's wheels encounter a pothole or curb, the metal rim of the wheels may become dented or bent so that the wheels are no longer circular, but rather take on an "oval" shape. Such a bent or oval wheel rim can cause potentially serious problems to the proper and safe operation of the motor vehicle. If a metal wheel rim is in any way damaged, the motor vehicle wheel will be off balance, resulting in excessive vibration and may also result in premature loss of air pressure in the tires. In addition, even newly manufactured wheel rims after casting may be bent slightly out of shape and off balance, thus also posing a similar problem and a safety hazard.

In accordance with one aspect of the present invention, there is provided a device useful for repairing the metal rims of bicycle or motor vehicle wheels. According to a further aspect of the present invention, a method is provided for repairing the metal rims of motor vehicle and bicycle wheels.

An embodiment of the present invention will now be described by way of example only with reference to the accompanying drawings, in which like numerals denote like parts in the several views, and in which.

Figure 1:
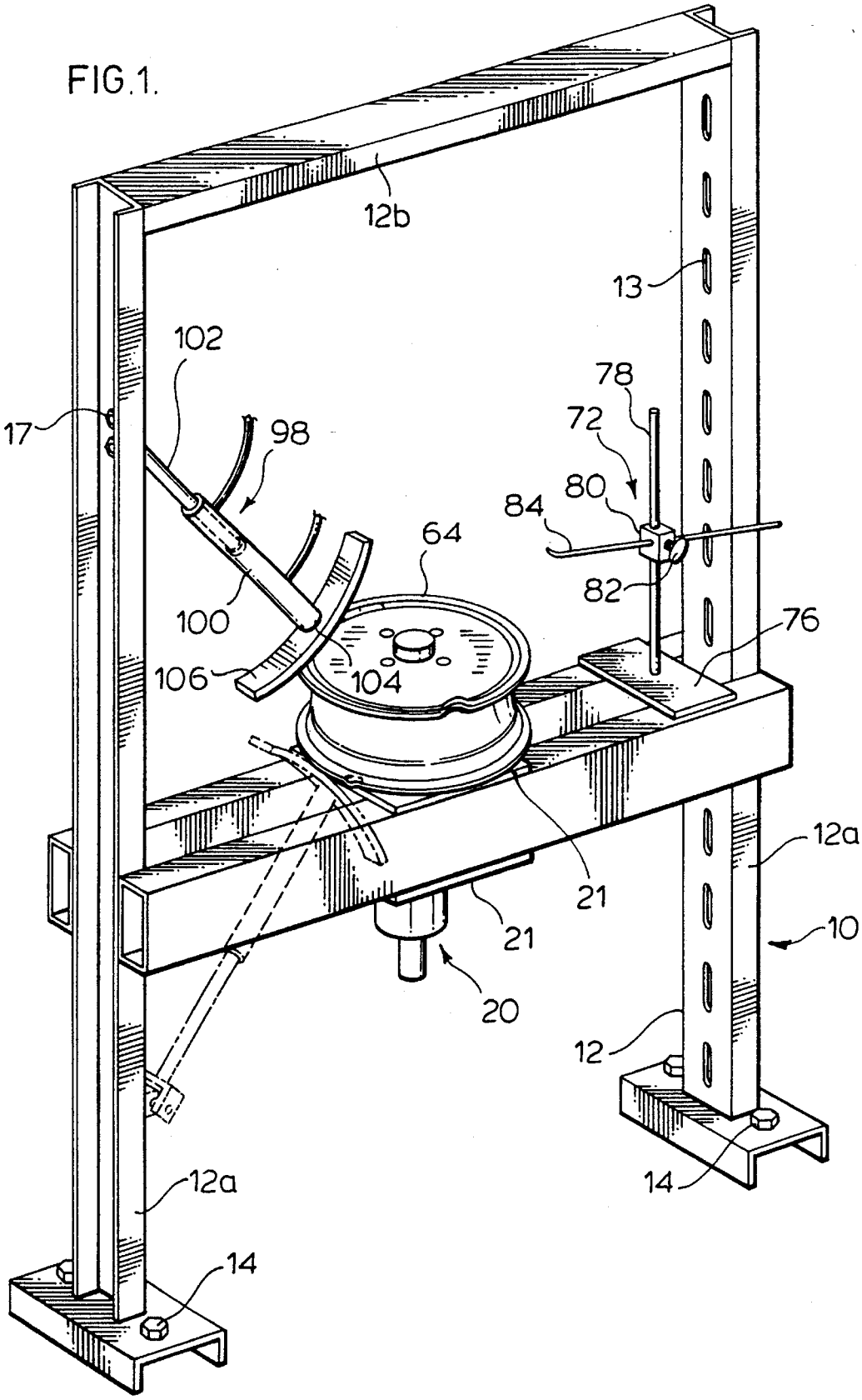
FIG. 1 is a perspective view of a wheel repair stand with a damaged wheel fitted.

Referring to FIG. 1, a wheel repair stand 10 includes a machine frame 12 welded from channel section structural steel and having uprights 12*a* and a horizontal beam 12*b*. The U-framed channel irons of frame 12 are securely connected together, preferably by welding or other means, to minimize vibration and movement of the entire device 10. The frame 12 is bolted to the floor with bolts 14, or other such securing means, to ensure that the overall structure of device 10 does not move or vibrate substantially while in use.

Slots 13 are formed in the inner faces of uprights 12*a* to receive a connecting block 15. Block 15 is secured to the frame uprights 12*a* by bolts 17 located in slots 13 to inhibit relative movement.

A pair of cross beams 16,18 are welded to either side of the uprights 12*a* and braced with triangular fillets 19. The beams 16,18 are structural steel channels positioned at approximately one meter from the floor to provide a convenient work height. A turntable 20 is located between the beams 16,18 and is secured to the upper and lower flanges of the beams by plates 21.

Figure 3:
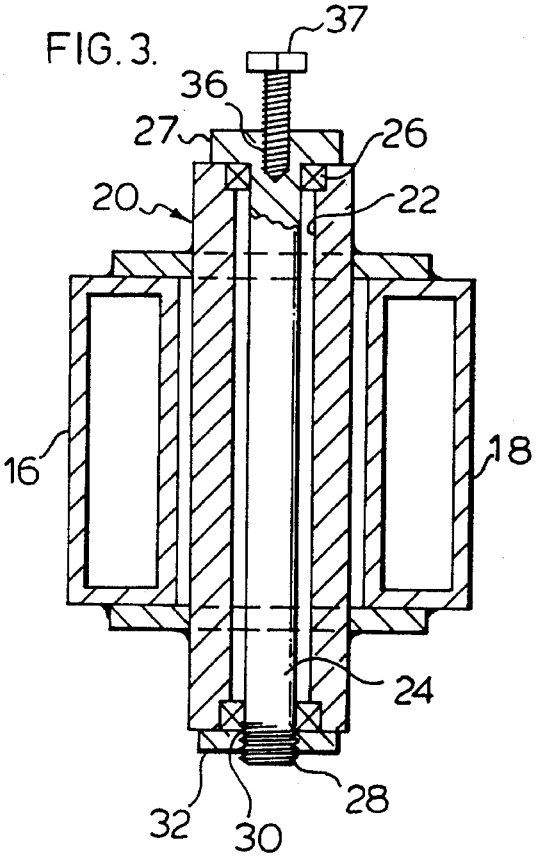
FIG. 3 is a section on the line 3—3 of FIG. 2.

Turntable 20 includes a tubular housing 23 having tube 20 a central bore 22 to receive a shaft 24. Shaft 24 is made of high tensile steel and is fitted into the bore 22 as best shown in FIG. 3. The shaft 24 is rotatably located by a pair of fitting bearings 26, 28, respectively, that are located at opposite ends of the housing 23 against shoulders 25. Upper end 34 of shaft 24 has an enlarged head 27 that overlies the bearing 26. The lower end 30 of shaft 24 is threaded to receive a bolt 32 to secure shaft 24 axially . As such, shaft 24 is able to rotate freely about its longitudinal axis once it is in place.

The size of shaft 24 is selected so as to be able to receive various sizes of motor vehicle wheel rims, as more fully described hereinbelow. Thus, different sized shafts may be needed depending on the variety of sizes of the wheel rim to be repaired. The two fitting bearings 26, 28 will, accordingly, also be of different sizes depending on the size of shaft 24 used. Typically, most wheel rims of cars can be mounted on the same size shaft 24, whereas a larger shaft 24 is required for truck wheel rims. As well, each of the fitting bearings 26, 28 and the shaft 24 will preferably be structurally larger and stronger where the metal rims of larger truck wheels are to be repaired.

Figure 4:
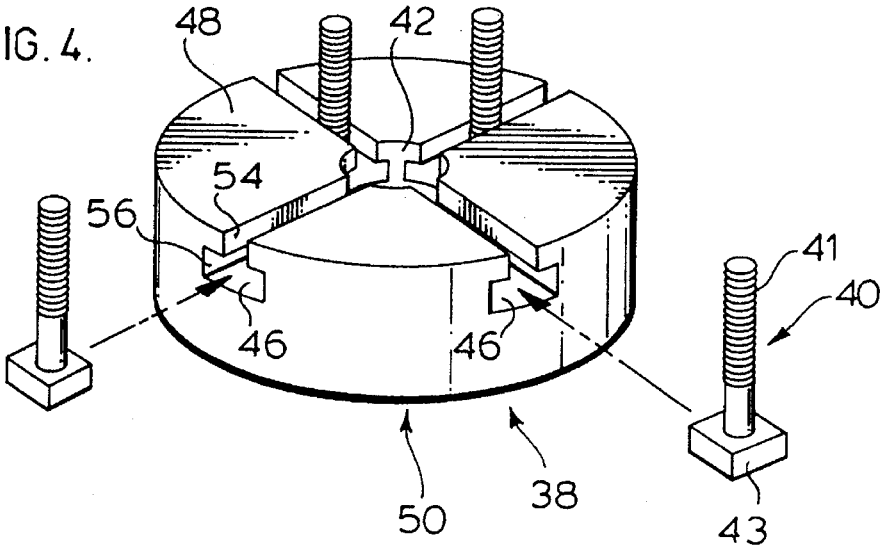
FIG. 4 is a perspective view of a component used to support a wheel on the stand of FIG. 2.
Figure 5:
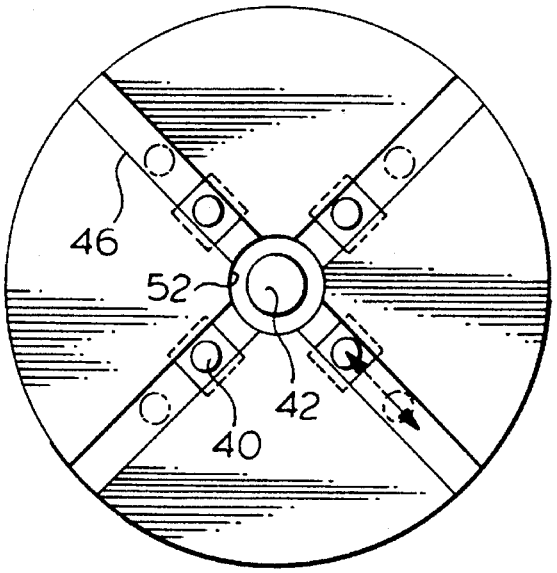
FIG. 5 is a plan view of the component of FIG. 4.

The head 27 of shaft 24 has an internally threaded bore 36 to receive a bolt 37. Typically, the width of wheel rims that can be repaired with the device 10 ranges from the wheel rims of bicycles to the wheel rims for trucks. A wheel is mounted on the shaft 24 by a support plate 38, an example of which is shown in FIGS. 4 and 5. The support plate 38 is preferably made of metal and is generally disc-shaped. The wheel rims of motor vehicles include retaining holes disposed at regular intervals through which bolts can be inserted for mounting and retaining the wheel rim on the motor vehicle's axle. The number of such retaining holes depends on the size of the wheel rim and type of motor vehicle, and typically varies from three to eight holes. Accordingly, a number of different configurations of support plates will be required to accommodate the different types of wheel in the example shown. The support plate 38 shown is designed for use with a four hole wheel rim.

Figure 6:
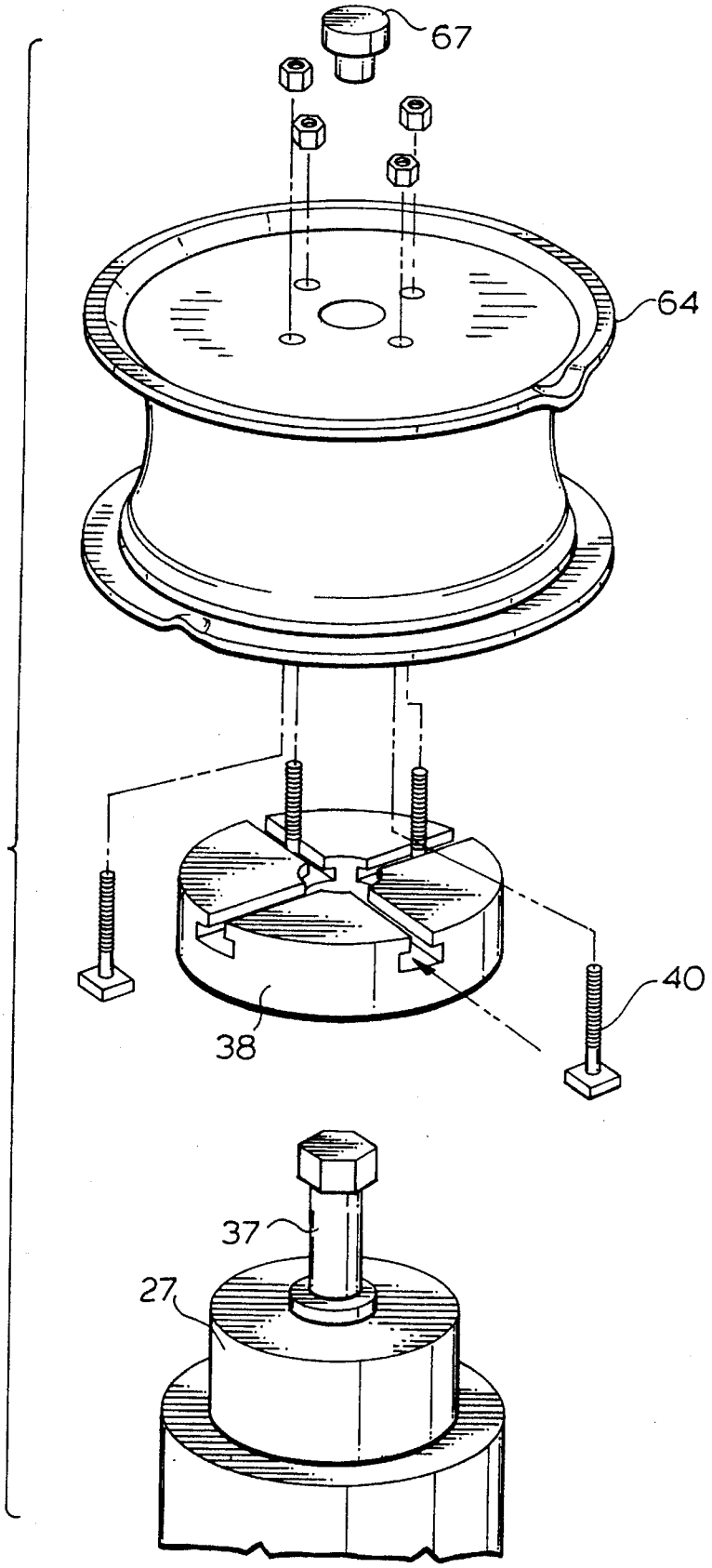
FIG. 6 is an exploded view of the damaged wheel mounted on the stand.
Figure 8:
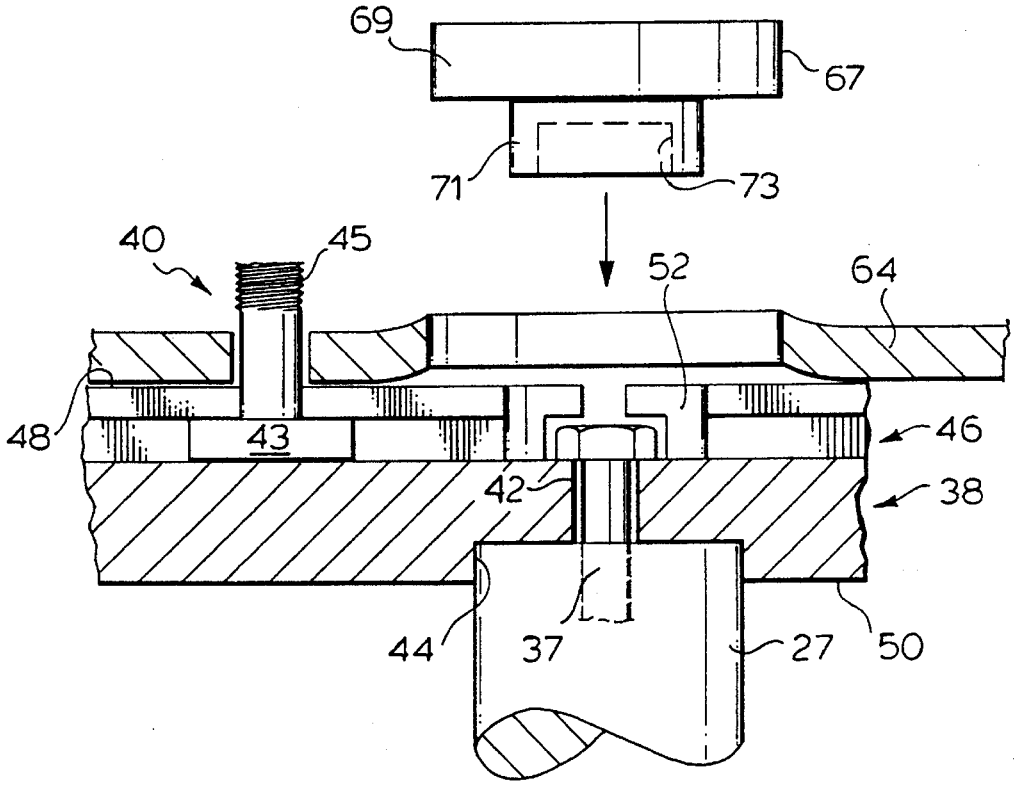
FIG. 8 is a section on the line 8—8 of FIG. 7.

As can be seen from FIGS. 6 and 8 the plate 38 has a top surface 48 and a bottom surface 50. A circular counterbore 44 is machined into the bottom surface 50 of plate 38 and is intended to receive the head 27 of shaft 24 therein. The top surface 48 of plate 38 includes undercut slideways 46 (FIG. 4) that radiate from a centre hole 42. Each slideway 46 includes a narrowed opening 54 and a wider portion 56. The head 43 of a bolt 40 is received in the wider portion 56 with its shank 41 projecting through the opening 54. The bolt 40 can thus slide radially in the channels 46, but nevertheless is retained on the plate 38 against axial movement. The hole 42 is counterbored, as indicated at 52, to accommodate the head of a bolt 37 which extends into the threaded bore 36 in shaft 24.

Figure 2:
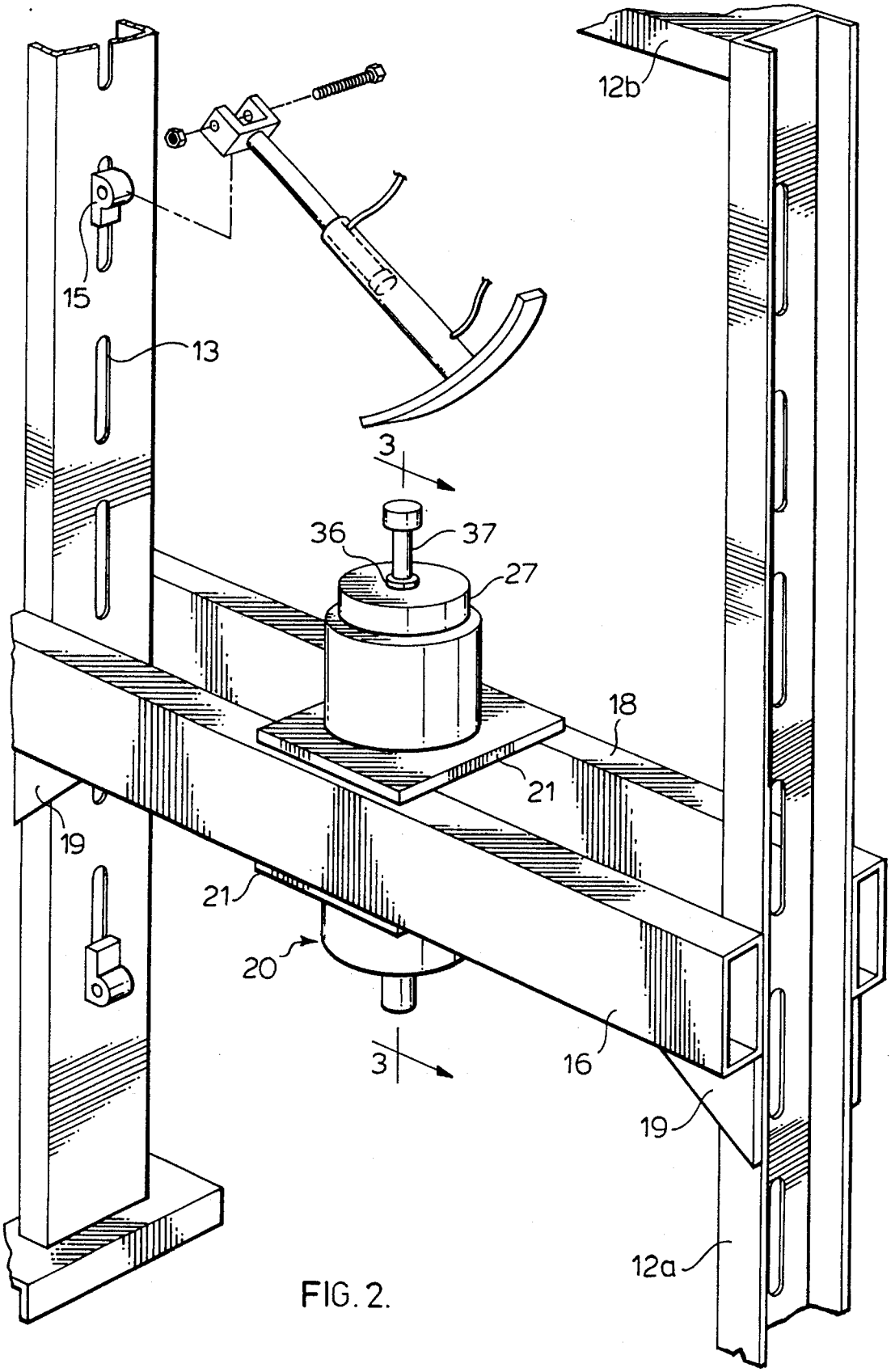
FIG. 2 is a perspective view on an enlarged scale of the components of the wheel repair stand of FIG. 1.

Referring back to FIG. 2, and also to FIG. 6, once plate 38 is mounted and secured to the top end 34 of shaft 24, a wheel rim 64 can then be mounted onto plate 38. The wheel rim is retained thereon by inserting the shanks 41 of bolts 40 through the retaining holes of the wheel rim 64, and securing it axially with suitable nuts 68 which are threaded on to shanks 41.

Wheel rim 64 is radially located on plate 38 by use of a machined support member 67 as shown in FIG. 8. Support member 67 is formed from a pair of concentric cylinders, one of which, 69, is wider than the other 71. The diameter of narrower cylinder 71 is slightly smaller than the diameter of counterbore 52 on plate 38, thereby allowing narrowed cylinder 71 to fit snugly therein and has a cylindrical recess 73 to accommodate the head of bolt 37. The diameter of wider portion 69 will vary depending on the diameter of the hub of the wheel rim 64 to be repaired. Since hub size generally varies with wheel size, the diameter of wider portion 69 will vary according so that it is slightly smaller than the hub, thus allowing a snug fit when the wheel hub is slipped over wider portion 69.

Figure 7:
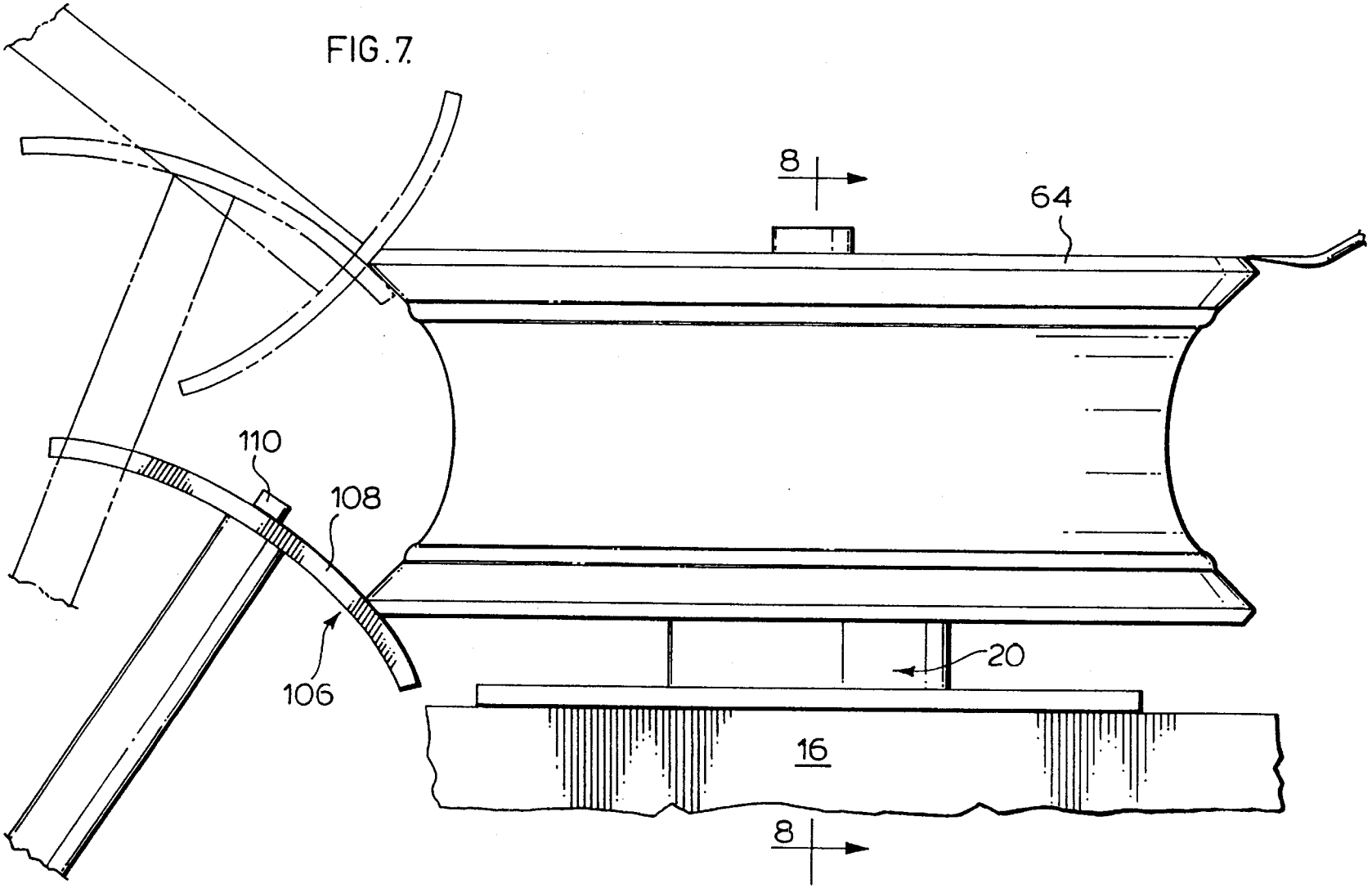
FIG. 7 is an enlarged view showing application of a repair tool to the damaged wheel.

The operation of the device is best seen from FIGS. 1, 6 and 7. A shaft 24 with a head height appropriate for the width and offset of the rim to be repaired is inserted into fitting bearings 26, 28 (not shown in FIG. 6) and retained by lock bolts 32. Head 27 of shaft 24 is inserted into machined portion 44 on bottom side 50 and bolt 37 is used to retain plate 38. The support member 67 is fitted over bolt 66 and into counterbore 52 of plate 38 so that the head of bolt 66 is received within recess 73. Wheel rim 64 is mounted onto plate 38 as shown, with the hub of wheel rim 64 slipped over support member 67. Shanks 41 of each bolt 43 are then inserted through the retaining holes of the wheel rim 64. Nuts 68 are used to securely retain wheel rim 64 on plate 38. Once mounted, wheel rim 64 can be rotated with shaft 24 relative to frame 12.

To check for eccentricity of the wheel 64 a measuring instrument 72 capable of moving along upper surface of beams 18 is utilised as seen in FIG. 1. Measuring instrument 72 includes a relatively massive base 76 to slide along the beams 16, 18 and an upright post 78 that extends from base 76 at a 90° angle. Slidably mounted on post 78 is a sleeve 80 having a tightening screw 82. Sleeve 80 can slide vertically along post 78 and can be retained at a desired location on post 78 by tightening screw 82. Extending at a 90° angle from sleeve 80 is a pointer 84 that can be adjusted relative to post 78.

The instrument 72 is used to determine which areas of a wheel rim 64 are dented or bent into an oval shape, thereby requiring repair, by positioning the pointer against the rim and rotating the wheel relative to the frame. Discrepancies will be observed by departure of the pointer from the rim and those areas marked.

Once the defects in the wheel have been determined, the wheel may be repaired by application of a force from a hydraulic power set 98 or other extensible tool. The power set 98 is secured to a connecting block 15 which is secured in an appropriate one of the slots 13. The position of the block 15 is chosen to suit the particular direction in which force is to be applied to correct that defect.

Hydraulic power set 98 is, typically a 10 ton set made by Black Hawk for use with car wheels, 20 ton for truck wheels, and 4 ton for motor cycle wheels. Set 98 comprises a cylinder 100 and piston 102 combination. A handle and pump (not shown) allow the user to hydraulically "pump" the piston 102 out of cylinder 100, and in the preferred embodiment, the set 98 can apply up to 10 tons of pressure. One end 104 of set is fitted with a press tip 106. Press tip 106 comprises a curved mild steel member 108 and a retainer 110 (FIG. 7). Retainer 110 releasably attached to member 108. Retainer 110 can be located at any desired position on member 108, and preferably, retainer 110 is attached at a either a 30°, 45°, 60°, 75° or 90° angle.

Once the wheel rim 64 is mounted and secured on plate 38, measuring instrument 72 can be moved toward wheel rim 64 so that the tip of pointer 84 is placed adjacent to outer wall 113 of wheel rim 64. By rotating wheel rim 64, pointer 84 can be used to determine which areas of rim 64 are dented. If rim 64 is not dented, then outer wall 113 will remain at approximately the same relative distance from pointer 84 as the rim 64 rotates. On the other hand, if there is a dent, that distance will very, thereby indicating the location of the dent.

The wheel rim 64 is tested from the top of the wheel rim outer wall 113 to the bottom. Pointer 84 can be moved vertically by sliding sleeve 80 along post 78. When a dented area is located, the position of the power set 98 is then adjusted to allow the press tip 108 to apply pressure on the dented area and thus repair that area. Once the dented area is repaired, wheel rim 64 is tested again to ensure the repair of the dented area did not cause a different area of the wheel rim 64 to become dented or bent out of shape. During the trimming process, the shaft permits the natural position of the rim to be adjusted for optimum application of the forces but resists axial movement. The radial loads applied are taken by the support member 37 to ensure accurate application of the forces from the hydraulic set.

If an area of an inner wall of the wheel rim 64 is damaged, the hydraulic power set 98 can still be used in the same fashion to repair that area. The distance between tube 20 and an inner wall is usually sufficiently great to allow the power set 98 to fit therein. The distance between tube 20 and the inner wall can be as small as 2 inches since porto power sets having cylinders that small are currently available on the market. The spacing of the beams 16,18 also permits the power set 98 to be applied from below rim.

If any portion of the surface of the wheel rim 64 is cracked or torn, or if the wheel rim 64 cracks or tears when pressure from the hydraulic power set 98 is applied thereto, an argon alloy gas torch or other suitable torch can be used to weld together the torn portion of the rim 64. The wheel rim 64 is then checked again and repaired as required to ensure that it is circular.

Once the wheel rim 64 is found to be substantially circular and thus repaired, it is removed from the device 10 and the wheel rim 64 can then be subjected to further repair or refurbishing if desired. For example, the wheel rim 64 may be polished, painted, etc.

Finally, the wheel rim 64 is, preferably, then checked on a typical motor vehicle wheel balancer to ensure that the wheel rim 64 is balanced within the specified calibration without a tire on the wheel rim 64. If the wheel rim does fall within the balancing specification, then the tire is fitted onto the wheel rims. As well, even newly manufactured wheel rims are often out of calibration and not within specification, therefore the device 10 and process of the present invention can be used to ensure that brand new wheel rims are not dented or bent and thus fall within specified calibrations.

Figure 9:
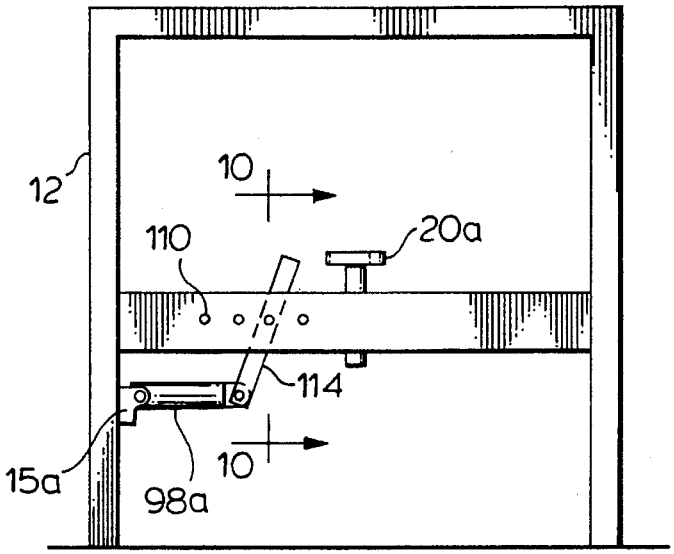
FIG. 9 is a front elevation of an alternative embodiment of a wheel repair stand shown in FIG. 1.
Figure 10:
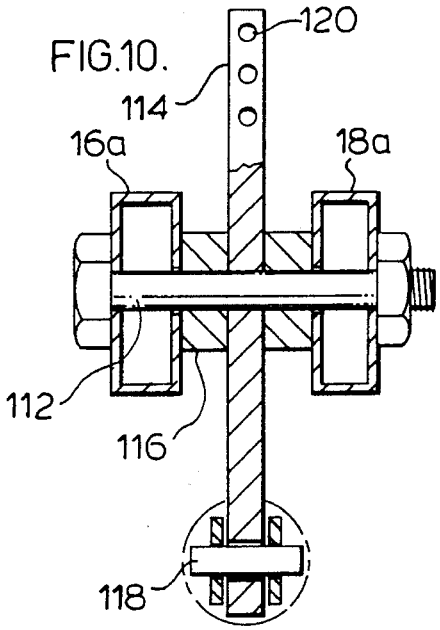
FIG. 10 is a view on the line 10—10 of FIG. 9.

An alternative arrangement is shown in FIGS. 9 and 10 to facilitate the repair of the internal surfaces of the wheel. Like reference numerals will be used to denote like components with the suffix "a" added for clarity. Referring therefore, to FIG. 9, support beams **16*a*, 18*a* are provided with a series of aligned holes 110** to one side of the turn table

20*a*. The aligned holes 110 receive a bolt 112 that pivotally supports a lever 114. Bushes 116 inhibit lateral movement of the lever 114 relative to the beams 16*a*, 18*a*.

The lower end of lever 114 is drilled to receive a pin 118 for connection to hydraulic power set 98*a*. The power set 98*a* is attached through a bracket 15*a* to the frame 12.

The upper end of lever 114 is bored as indicated at 120 to receive tool bits (not shown) of different standard configurations.

With the arrangement shown in FIGS. 9 and 10, the lever 114 may be positioned radially inwardly of the rim of a wheel mounted on the turn table 20*a* and a radially outward force applied through the hydraulic power set 98*a*. The position of the lever 114 may be adjusted on the beams 16*a*, 18*a* to accommodate different diameters of wheel and different tools may be fitted to the upper end of levers 114 as necessary.

The positioning of the power set 98*a* below the beams 16*a*, 18*a* enables different hydraulic cylinders to be utilized in the power set with longer strokes if necessary. Clearly the position of the power sets 98*a* can be adjusted on the frame 12 to suit particular requirements although generally it is preferable for the cylinder to be disposed parallel to the beams 16*a*, 18*a*.

In summary, the device and method of the present invention is useful for repairing metal wheel rims used on motor vehicles. Essentially, any type of dent on the wheel rim can be repaired so that the wheel rim is rendered round again. The device and method of the present invention can be used on any type of wheel rim, for example, those used on cars, trucks, motorbikes, etc. Preferably, the wheel rim is made of aluminum, but it will be understood by those skilled in the art that any metal wheel rim can be repaired accordingly.

It will be understood by persons skilled in the art that modifications and alterations are possible to the present invention. All such modifications and alterations are considered to be within the scope of this invention.

I claim:

1. A wheel repair stand comprising a pair of vertical frame members spaced apart from one another and each having a plurality of discrete attachment points spaced from one another along said frame members, a support extending between said frame members and having a pair of beams laterally spaced from one another to provide an elongate slot extending between said frame members, a turntable mounted on said support between said frame members and including a shaft rotatable relative to said support about a vertical axis and a platform secured to said shaft to receive a wheel rim, said platform having a boss to engage said wheel rim and inhibit relative radial movement between said rim and said platform, said stand further including at least one attachment bracket selectively positionable at one of said attachment points and operable to support an extensible tool in applying a force between a selected position of said rim and said frame.

2. A wheel repair stand according to claim 1 wherein each of said attachment points includes an elongate slot to receive an attachment bracket.

3. A wheel repair stand according to claim 1 wherein said platform is detachably secured to said spindle.

4. A wheel repair stand according to claim 3 wherein said platform includes a plurality of bolts projecting upwardly from said platform to secure said rim to said platform.

5. A wheel repair stand according to claim 3 wherein said shaft is removably secured in said housing to inhibit relative axial movement between said housing and said shaft.

6. A wheel repair stand according to claim 5 wherein said bolts are radially adjustable on said platform.

7. A wheel repair stand according to claim 1 wherein a lever is pivotally connected intermediate its ends to said beams to one side of said turntable, one end of said lever projecting above said support and an actuator extending between one of said frame members and another end of said lever.

8. A wheel repair stand according to claim 7 wherein a hydraulic actuator extends between said one end of said lever and one of said uprights.

9. A wheel repair stand according to claim 8 wherein said lever includes means to support a tool at an end opposite to said actuator.

* * * * *